US006057785A

United States Patent [19]

Guthrie

[11] Patent Number: 6,057,785

[45] **Date of Patent: *May 2, 2000**

[54] VEHICLE WARNING SIGN SYSTEM

[76] Inventor: Donald A. Guthrie, W9212 Rat Hollow, Argyle, Wis. 53504

[ * ] Notice: This patent issued on a continued prosecution application filed under 37 CFR 1.53(d), and is subject to the twenty year patent term provisions of 35 U.S.C. 154(a)(2).

[21] Appl. No.: 09/040,785

[22] Filed: Mar. 18, 1998

[51] Int. Cl.[7] ..... G08G 1/00

[52] U.S. Cl. ..... 340/904; 340/902; 340/906; 340/994

[58] Field of Search ..... 340/539, 902, 340/904, 905, 994, 906

[56] References Cited

U.S. PATENT DOCUMENTS

| | | | |
|---|---|---|---|
| D. 331,718 | 12/1992 | Walker | D10/114 |
| 4,297,672 | 10/1981 | Fruchey et al. | 340/994 |
| 4,325,058 | 4/1982 | Bishop | 340/539 |
| 4,843,337 | 6/1989 | Conn, Jr. et al. | 340/904 |
| 4,857,921 | 8/1989 | McBride et al. | 340/904 |
| 4,857,925 | 8/1989 | Brubaker | 340/994 |
| 4,893,903 | 1/1990 | Thakar et al. | 350/334 |
| 5,021,780 | 6/1991 | Fabiano et al. | 340/539 |
| 5,144,301 | 9/1992 | Jackson et al. | 340/944 |
| 5,202,683 | 4/1993 | Hamer et al. | 340/906 |
| 5,231,393 | 7/1993 | Strickland | 340/905 |
| 5,345,232 | 9/1994 | Robertson | 340/906 |
| 5,572,201 | 11/1996 | Graham et al. | 340/904 |
| 5,677,684 | 10/1997 | McArthur | 340/902 |

*Primary Examiner*—Daniel J. Wu
*Attorney, Agent, or Firm*—Ryan Kromholz & Manion S.C.

[57] ABSTRACT

A vehicle warning sign system for alerting motorists of the existence of a vehicle, such as a school bus, stopped ahead, the system including a transmitter attached to the vehicle for transmitting a wireless signal to a receiver mounted on a sign structure, the sign structure having at least one visual indicator coupled to the receiver for producing a visual signal, the sign structure having an energy source coupled to the visual indicator and the receiver, and the visual indicator being activated when the receiver receives the wireless signal.

5 Claims, 2 Drawing Sheets

VEHICLE WARNING SIGN SYSTEM

BACKGROUND OF THE INVENTION

In both urban and rural areas, it is common practice for school children and young students to ride to school using buses operated by the city or county school system or by a private company. Buses have predetermined routes and stop at selected places along those routes.

In urban areas, stops are frequent and buses usually pick up children in areas with good visibility and multiple traffic signs. However, in the suburbs or in rural areas, it is not uncommon to see buses travel many miles along their particular routes and stop in sometimes unsafe conditions, such as directly on the highway, along sharp curves, downhill, in obstructed intersections, or other "blind" areas where drivers may not be able to see a stopped school bus far enough to safely slow down and stop.

The present invention remedies this situation and creates a safer environment for school children and bus drivers as well. It is an object of the present invention to provide a system which will improve the safety of motorists, bus drivers, and children riding on the bus. It is another object of this invention to provide a system that is easy to manufacture and would use electronic equipment readily available. It is further an object of this invention to provide such system needed to prevent road accidents.

While the application of the present invention to school buses is discussed above, it should be understood that the invention could be utilized for numerous other applications. For example, the warning sign system could be installed in an area where trucks are frequently backing into loading docks that are adjacent to the road. The invention may also be utilized by quarier or industrial parks when slow accelerating trucks are frequently pulling out into traffic along a busy road or highway.

SUMMARY OF THE INVENTION

The present invention relates generally to traffic signs and, more particularly, to a vehicle warning sign system designed to alert motorists that a vehicle, such as a school bus, is stopped ahead, directly in a lane of traffic or along the road side.

The vehicle warning sign system comprises a transmitter attached to a vehicle for transmitting a wireless signal to a sign located in the proximity of a route of the vehicle and a receiver permanently mounted to the sign for receiving the wireless signal. A plurality of such signs and such receivers may be installed along the route of the vehicle. The transmitter further includes a switch mechanism located within the vehicle designed to activate the transmitter. The sign comprises two visual indicators, preferably intermittent lights, coupled to the receiver for producing a visual signal while the receiver receives the wireless signal. The visual indicators and the receiver could be coupled to an energy source or to nearby power lines.

Before the vehicle leaves for its daily route, the vehicle driver actuates the switch mechanism. The transmitter sends a continuous radio signal, which is received by the receiver or receivers located in the proximity of the vehicle within the transmitting range. An electrical signal is then sent from the receiver to the visual indicators, activating the intermittent lights or other warning indicia. The visual indicators continue to signal the presence of the vehicle for a predetermined period of time after the transmitter is out of range, for example 2 minutes, and then shut off. The method of activation of the transmitter need not be limited to physical actuation of the switch mechanism. Any type of mechanism capable of activating the transmitter could potentially be used: e.g. a voice activated computer control. When the vehicle driver turns off the switch mechanism at the end of the trip, the transmitter quits broadcasting the signal. If the vehicle, such as a school bus, is utilized for a non-bus route function (i.e. transporting students on a field trip), the switch mechanism is deactivated to prevent the transmitter from activating any warning signs in the vicinity.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 5:
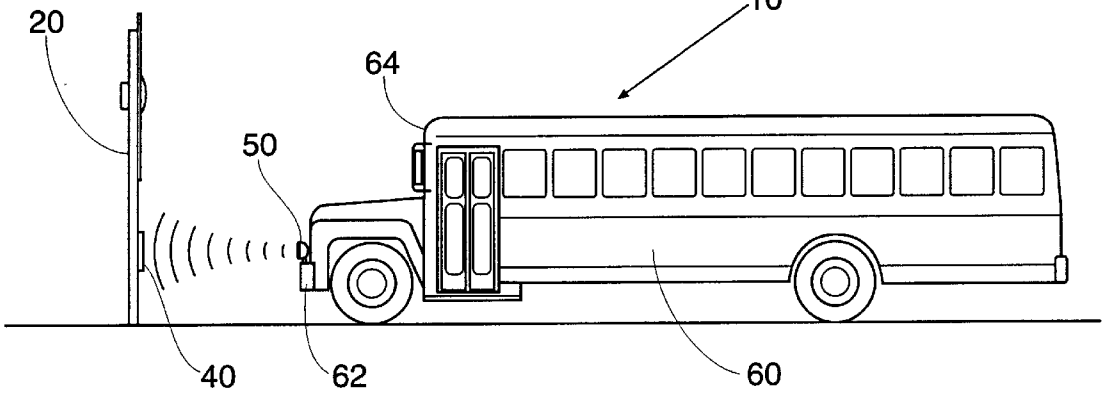
FIG. 5 is a side view of the preferred embodiment of the present invention, showing a vehicle having a transmitter and a sign structure having a receiver.

The preferred embodiment of the vehicle warning sign system, designated generally as 10, is illustrated in FIG. 5. Referring to FIG. 5, the vehicle warning sign system 10 includes a transmitter 50 for transmitting radio wireless signals and a receiver 40 for receiving those signals. The transmitter 50 is typically mounted on a vehicle, such as a school bus, 60, anywhere on the chassis, but preferably on the mask 62 or the top 64 of the vehicle 60. It may also be mounted to the vehicle's bumper. The transmitter 50 has a predetermined transmitting range and is known in the art. The receiver 40 is preferably mounted on a sign structure 20. The receiver 40 has a predetermined receiving range and is known in the art. The transmitter 50 and the receiver 40 are similar to the type used for a garage door opener. The sign structure 20 is located in the proximity of a route of the vehicle 60.

Figure 1:
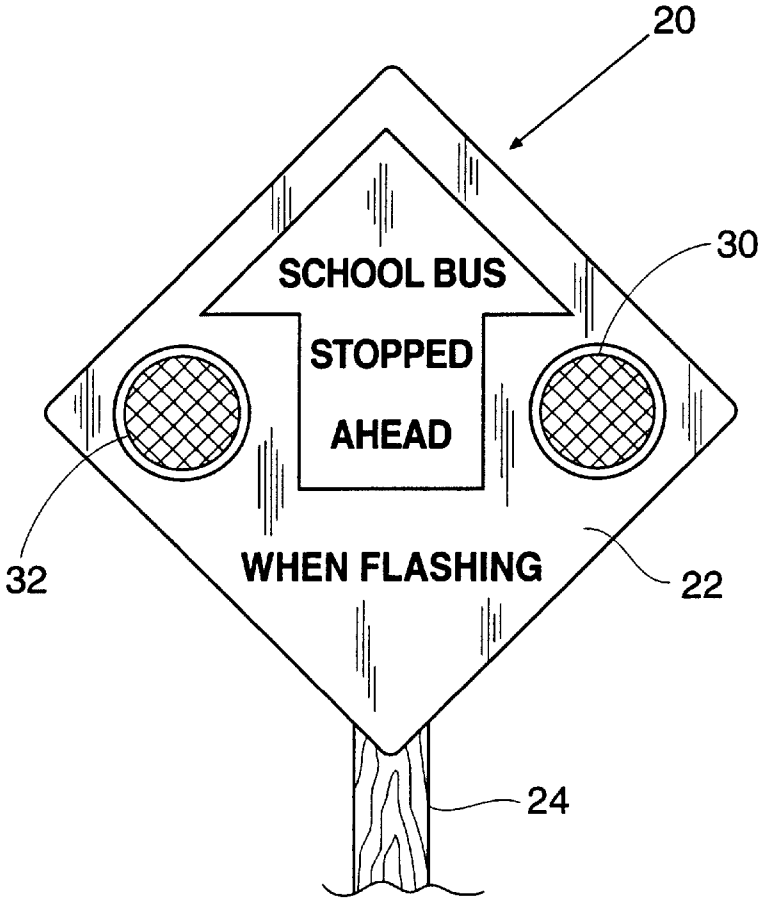
FIG. 1 is a front view of the sign showing the visual indicators.

Referring to FIG. 1, the sign structure 20 includes a flat, diamond-shaped sign 22 mounted atop of a standard post 24 at a predetermined height. The receiver 40 is typically mounted on the post 24, but could also be mounted anywhere on the sign structure 20. A plurality of sign structures 20 and receivers 40 may be installed along the route of the vehicle 60 at predetermined distances of the locations where the vehicle 60 needs to stop. The sign 22 comprises at least one and preferably two visual indicators 30, 32 coupled to the receiver 40. The visual indicators produce intermittent light signals when the receiver 40 receives the wireless radio signal coming from the transmitter 50. It should be understood that audio indicators could be used in place of or in addition to the visual indicators.

Figure 2:
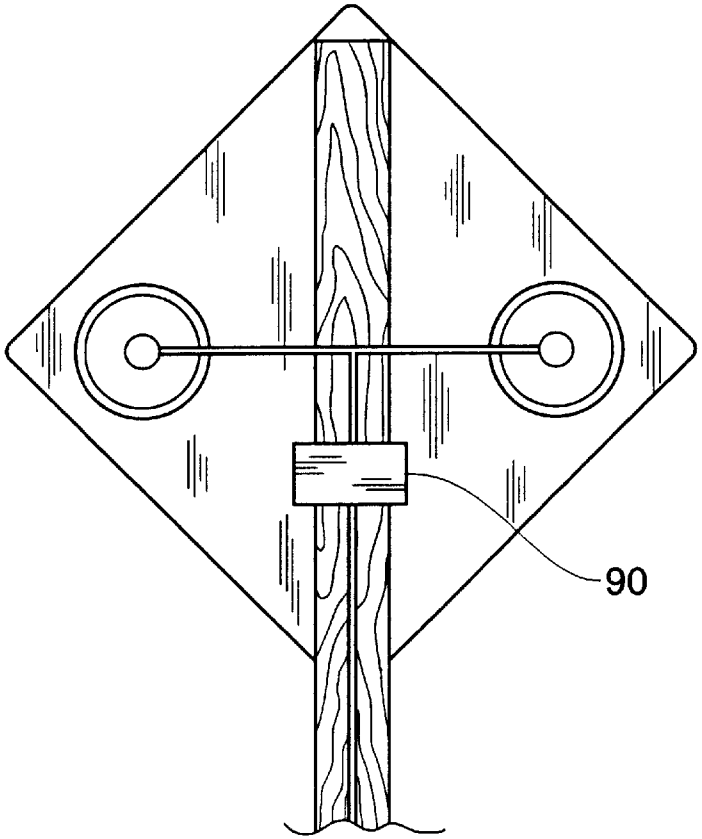
FIG. 2 is a rear view of the sign showing the energy source.

As shown in FIG. 2, the receiver 40 and the visual indicators 30, 32 require an energy source 90. The energy source 90 can be a separate battery pack as shown in FIG.

Figure 3:
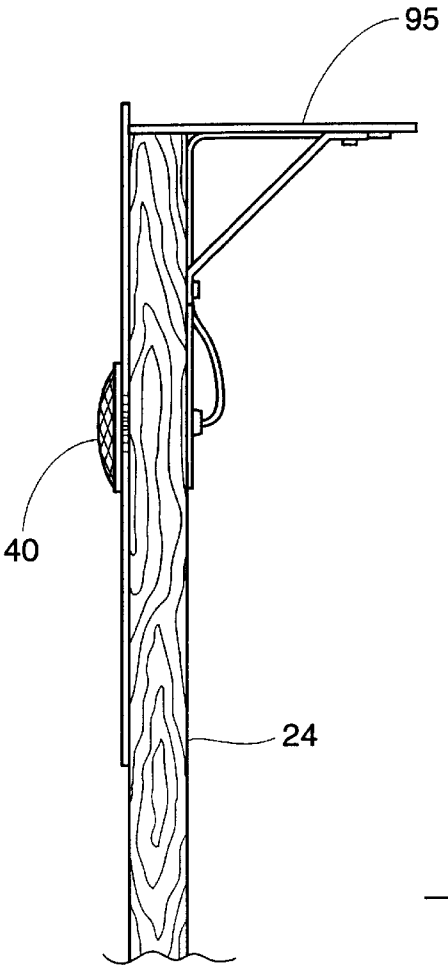
FIG. 3 is a side view of an alternate embodiment of the sign structure showing a solar panel as an energy source.

2, or any other power supply source, including a solar rechargeable battery with a solar panel 95, as shown in FIG. 3, or an electric connection to nearby power lines. The transmitter 50 obtains its power directly from the vehicle 60's power source.

Figure 4:
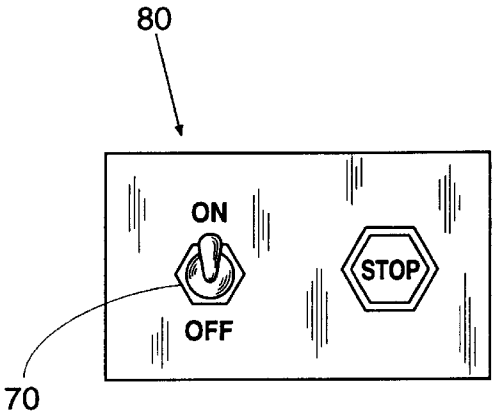
FIG. 4 is a front view of the control panel of the present invention.

Referring to FIG. 4, the vehicle driver operates a control panel 80 located within the vehicle 60 comprising a warning light switch 70. The warning light switch 70 is coupled to the transmitter 50 and is preferably a manual switch, although any type of mechanism capable of activating the transmitter 50 could potentially be used. When warning light switch 70 is activated or in the "on position", transmitter 50 is emitting a radio signal. When deactivated, no signal is broadcast.

As the vehicle 60 begins its daily route, the driver actuates the warning light switch 70. As a result, the transmitter 50 starts to broadcast a radio signal, which is received by the receiver 40 located on the sign structure 20 when the vehicle 60 enters the transmitting range. When the receiver receives the radio signal, an electrical or electromechanical switch closes thereby energizing the warning indica mounted to the sign. An electrical signal is then sent from the receiver 40 to the visual indicators 30, 32, activating the visual intermittent lights. The visual indicators 30, 32 continue to signal the presence of the vehicle 60 in the proximity of the sign 22 for the duration of the radio signal plus a predetermined period of time, usually 2 minutes, and then shut off automatically. As the vehicle 60 moves along its route, other receivers 40 pick-up the radio signal broadcast by the transmitter 50. As a result, the presence of the vehicle 60 is signaled to other motorists throughout the route. When the driver turns off the warning light switch 70 at the end of the trip, the transmitter 50 stops sending the radio signal.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A warning system for alerting an approaching vehicle of the presence of a stopped or slower first moving vehicle traveling thereahead, said system including:

at least one alerting sign structure;

a transmitter attached to said first vehicle and arranged to transmit a wireless radio signal;

a radio signal receiver mounted on said sign structure and adapted to receive said transmitted wireless radio signal;

said alerting sign structure including at least one visual indicator coupled to said radio signal receiver for producing a visual signal when said receiver receives said wireless radio signal; and said sign structure further including an energy source coupled to said visual indicator and to said receiver.

2. The warning system of claim 1, wherein said alerting sign structure has two visual indicators.

3. The warning system of claim 1, wherein said transmitter further comprises at least one switch mechanism for activating said transmitter.

4. The warning system of claim 1, wherein said visual indicator produces a visual signal for a predetermined period of time, after said receiver stops receiving said wireless radio signal.

5. The warning system of claim 1, wherein said stopped or slower moving first vehicle is a public conveyance vehicle.

* * * * *